US006885991B2

(12) United States Patent
Skonberg et al.

(10) Patent No.: US 6,885,991 B2
(45) Date of Patent: Apr. 26, 2005

(54) TELEPHONY-BASED SPEECH RECOGNITION FOR PROVIDING INFORMATION FOR SORTING MAIL AND PACKAGES

(75) Inventors: Carl M. Skonberg, Wyckoff, NJ (US); John C. Coggshall, New Haven, CT (US); Jennifer M. Edwards, Chester, NY (US)

(73) Assignee: United Parcel Service of America, Inc., Atlanta, GA (US)

( * ) Notice: Subject to any disclaimer, the term of this patent is extended or adjusted under 35 U.S.C. 154(b) by 865 days.

(21) Appl. No.: 09/732,420

(22) Filed: Dec. 7, 2000

(65) Prior Publication Data

US 2002/0072897 A1 Jun. 13, 2002

(51) Int. Cl.[7] ..... G10L 21/00; B07C 5/00

(52) U.S. Cl. ..... 704/270; 704/270.1; 209/44.1; 209/584

(58) Field of Search ..... 704/270.1, 270, 704/251, 260, 231; 209/44.1, 584, 699, 700, 702, 44.4

(56) References Cited

U.S. PATENT DOCUMENTS

| | | | | |
|---|---|---|---|---|
| 4,556,944 | A | 12/1985 | Daniels et al. | |
| 4,832,204 | A | 5/1989 | Handy et al. | |
| 4,921,107 | A | 5/1990 | Hofer | |
| 5,208,449 | A | 5/1993 | Eastman et al. | |
| 5,247,433 | A | 9/1993 | Kitaura et al. | |
| 5,305,244 | A | 4/1994 | Newman et al. | |
| 5,677,834 | A | 10/1997 | Mooneyham | |
| 5,794,789 | A | 8/1998 | Payson et al. | |
| 6,394,278 | B1 * | 5/2002 | Reed | 209/44.4 |
| 6,707,821 | B1 * | 3/2004 | Shaffer et al. | 370/395.4 |

FOREIGN PATENT DOCUMENTS

| | | |
|---|---|---|
| WO | WO-96/38800 | 12/1996 |
| WO | WO-00/59649 | 10/2000 |

OTHER PUBLICATIONS

Simultaneous Voice And Data Technology; www.netcom-m.com.au/services/dsvd technology ; Aug. 12, 1998.

BOCA Research Technologies; Copyright 1999 Boca Research, Inc.; www.bocaresearch.com/technologies/ds-vd.html ; Dec. 17, 1999.

Series VL2H Product Description; www.vcivoice.com/VL2h.htm; Mar. 7, 2000.

International Search Report for PCT/US01/47255, completed Mar. 25, 2002.

* cited by examiner

*Primary Examiner*—Abul K. Azad
(74) *Attorney, Agent, or Firm*—Alston & Bird LLP

(57) ABSTRACT

The present invention relates to a telephony-based speech recognition system for sorting packages and letters. The invention includes a wireless telephony set in communication with a computer through a telephony system or network. Sortation information spoken by a user is sent by the wireless telephony set to a speech device or modem. A signal containing the spoken sortation information is sent by the speech device or modem through the telephony system or network to a computer. A stored set of instructions such as a speech recognition program interprets the signal to obtain the spoken sortation information. The computer generates a return signal, such as a data signal, an encoded voice signal, or both, in response to the spoken sortation information. A second modem encodes the return signal and sends the return signal through the telephony system or network to the speech device or modem. The speech device or modem decodes the return signal into a data signal for output to a local computer and a voice signal for output to the user.

21 Claims, 3 Drawing Sheets

TELEPHONY-BASED SPEECH RECOGNITION FOR PROVIDING INFORMATION FOR SORTING MAIL AND PACKAGES

TECHNICAL FIELD

The present invention relates generally to mail and package sortation systems, and relates more specifically to a telephony-based speech recognition system for providing information for sorting mail such as packages.

BACKGROUND OF THE INVENTION

Generally described, mail or package sortation can be a labor-intensive task. The sortation of mail or packages involves the use of a delivery address affixed to the mail or package. Operations including transportation, weighing, and sorting depend upon the reading of the delivery address. Once the delivery address is read, operations such as automated sorting and the creation of shipment records and billing documents rely upon the delivery address for the accuracy of the records and documents.

Conventional speech recognition systems have been employed by mail or package delivery companies to increase the efficiency of mail and package sortation. Generally, a user's speech input provides delivery address information to a remote computer. The remote computer processes the user's voice or speech input to compare the delivery address to a stored database of correct address information. The remote computer returns feedback to the user regarding the user's speech input. A computer can provide audio or visual feedback to the user regarding a delivery address. Audio feedback can take the form of an audio signal played back to the user via an earphone, headphone, or speaker. Visual feedback can take the form of a video signal sent to a display screen or monitor for viewing by the user. Conventional sortation systems provide a signal to the user in the form of either an audio signal or a video signal for a display screen. The user receives the feedback from the computer, and the user acts accordingly in response to the signal.

One attempt at a speech recognition sortation system discloses a portable transaction terminal with a bar code reader, a microprocessor, a transceiver, a modem, a visual display, and a speech recognition system incorporated into a headset. When a user performs a sorting operation, the microprocessor receives information input from the bar code scanner or from the output of the speech recognition system processing alphanumeric names and words spoken by the user into the headset. Via the modem, the tranceiver can exchange information with a remotely located modem. The microprocessor provides the user with preset audio messages through the headset or with information on the visual display. One drawback to the described equipment is that a headset incorporating features such as a bar code reader, a transceiver, a modem, a display, and a speech recognition system into a single headset makes the headset a complicated and expensive piece of equipment that could be uncomfortable for the user to wear and to operate. Furthermore, a headset containing such complex equipment could be expensive to manufacture and to maintain. Another drawback to the equipment is that the microprocessor cannot send a simultaneous signal, that is, an audio signal to the headset and a signal for the visual display, to the user for feedback.

Another attempt in the art to use speech recognition in mail or package sortation operations includes a headset and a self-contained portable computing apparatus. The computing apparatus includes a speech recognition module, and the headset includes a display for the user, and a microphone and speaker. When the user inputs voice data to the apparatus, the apparatus processes the information with an attached portable computer that provides data feedback to the user in the form of audio feedback through the headset or with visual information on the display. As with the portable transaction terminal described above, one drawback to the described portable computing apparatus is that a headset incorporating features such as a speech recognition module, a display, a microphone, and a speaker into a headset makes the headset a complicated and expensive piece of equipment that could be uncomfortable for the user to wear and to operate in conjunction with a portable computer also worn by the user. Furthermore, a headset containing such complex apparatus could be expensive to manufacture and to maintain. Another drawback to the apparatus is that the portable computer cannot send a simultaneous signal, that is, an audio signal to the headset and a signal for the visual display, to the user for feedback.

Yet another attempt in the art uses a portable computer carried on the body of the user. The user communicates with the portable computer through a microphone installed in a headset. Spoken address information is sent by the user to the portable computer, where the information is processed into sorting information provided to the user. Again, a drawback is that the headset and portable computer could become uncomfortable for the user to wear and to operate. Furthermore, another drawback is that the portable computer cannot send simultaneous signals, that is, an audio signal to the headset and a signal for the visual display, to the user for feedback.

Therefore, there is a need in the art for a speech recognition system for sorting mail such as packages that is comfortable to wear, and easier to operate and to maintain than conventional systems and apparatuses. Furthermore, there is a need for a speech recognition system for sorting mail such as packages that can return simultaneous signals, that is, an audio signal to the headset and a signal for the visual display, to the user for feedback.

SUMMARY OF THE INVENTION

The present invention seeks to solve the problems described above. The present invention provides a telephony-based speech recognition system for providing information for sorting mail and packages that is comfortable to wear, easier to operate and to maintain than conventional systems and apparatuses. Furthermore, the present invention provides a telephony-based speech recognition system for providing information for sorting mail and packages that can return simultaneous signals to the user for feedback. That is, the system provides simultaneous signals such as a voice signal to a user's headset and a data signal for a display screen or monitor for visual display of information. These objects are accomplished according to the present invention in a telephony-based speech recognition system for providing information for sorting mail and packages.

A telephony-based speech recognition system that provides the advantages above translates into a lower cost delivery address data acquisition and return system. Simultaneous signals sent in response to a user's spoken delivery address input can provide the user with multiple forms of feedback, and can provide one or more users the same or similar feedback for performing one or more different sortation or delivery operations. In addition, advantages such as user comfort in wearing equipment, ease of equipment operation, and lower maintenance costs, together reduce the overall costs involved in operating a speech recognition system for sorting mail and packages.

Generally described, the system includes a wireless telephony set for sending sortation information spoken by a user. A first modem receives the spoken sortation information from the wireless telephony set, and sends the spoken sortation information to a second modem through a telephony system. The second modem receives the spoken sortation information through the telephony system, and sends the spoken sortation information to a computer. The computer receives the signal containing the spoken sortation information from the second modem. The computer processes the signal using a speech recognition program, and in response to the spoken sortation information, the computer generates a return signal with a voice signal and a data signal. The computer sends the voice signal and the data signal to the second modem. The second modem encodes the data signal with the voice signal and sends the encoded return signal to the first modem through the telephony system. The first modem decodes the encoded return signal into the data signal and the voice signal. The first modem sends the voice signal to the wireless telephony set, and sends the data signal to associated equipment such as a local computer for other feedback uses such as a visual display on a screen display or printing a label on a printer.

More particularly described, the wireless telephony set includes a microphone and a transmitter. When a user reads sortation information, such as a delivery address associated with a package, into the microphone, the transmitter sends a signal at a radio frequency to a base phone receiver. The base phone receiver sends the voice signal to a first simultaneous voice and data (SVD) modem. The first SVD modem transmits the voice signal through a public switched telephone network (PSTN) to a second SVD modem.

A second SVD modem receives the voice signal, and sends the signal through a telephony interface to a computer. The computer executes a stored set of instructions such as a speech recognition program to determine the spoken sortation information from the voice signal. In response to the sortation information, the computer generates a return signal with a voice signal and a data signal that is sent back to the second SVD modem. The SVD modem encodes the data signal with the voice signal so that a combination of signals may be sent by the second SVD modem through the public switched telephone network (PSTN) to the first SVD modem. The first SVD modem receives the return signal and decodes the return signal into the voice signal and the data signal. The first SVD modem sends the voice signal to the base phone receiver, and the base phone receiver sends the voice signal to the wireless telephony set. The receiver of the wireless telephony set transmits the voice signal to the speaker for output to the user.

The first SVD modem sends the data signal to a local computer, a printer, a display screen, or any combination of peripheral devices. The data signal can be used to format a label or a screen display. In one preferred embodiment, the data signal can be sent directly to a printer to print a label. Alternatively, the data signal can be sent directly to a display screen for viewing by a user.

In another aspect of the invention, the invention works in conjunction with a local area network (LAN) of computers. A user speaks sortation information into a microphone of a wireless set. The microphone transmits the spoken sortation information to a transmitter. The transmitter sends a signal containing the spoken sortation information over a radio frequency to a speech device such as a speech encoder/decoder. The speech encoder/decoder sends a voice signal through a LAN to a computer. The computer receives the voice signal containing the spoken sortation information. A stored set of instructions such as a speech recognition program interprets the voice signal into the spoken sortation information. In response to the spoken sortation information, the computer generates a return signal with a voice signal and a data signal. The computer encodes the data signal with the voice signal, and sends the encoded signals through the LAN to the speech encoder/decoder. The speech encoder/decoder decodes or separates the return signal into the voice signal and the digital signal. The voice signal is sent to the receiver of the wireless set. The receiver transmits the voice signal to the speaker for output to the user. The voice signal can contain audio instructions or otherwise provide feedback for the user in response to the spoken sortation information.

The return signal can also be sent to a local computer through the LAN. The local computer decodes the return signal into the data signal. The data signal is sent to an associated printer, display screen or other peripheral device to format a label, display results, or otherwise provide feedback in response to the spoken sortation information.

Other objects, features, and advantages of the present invention will become apparent upon reading the following specification, when taken in conjunction with the drawings and the appended claims.

DETAILED DESCRIPTION OF INVENTION EMBODIMENTS

Figure 1:
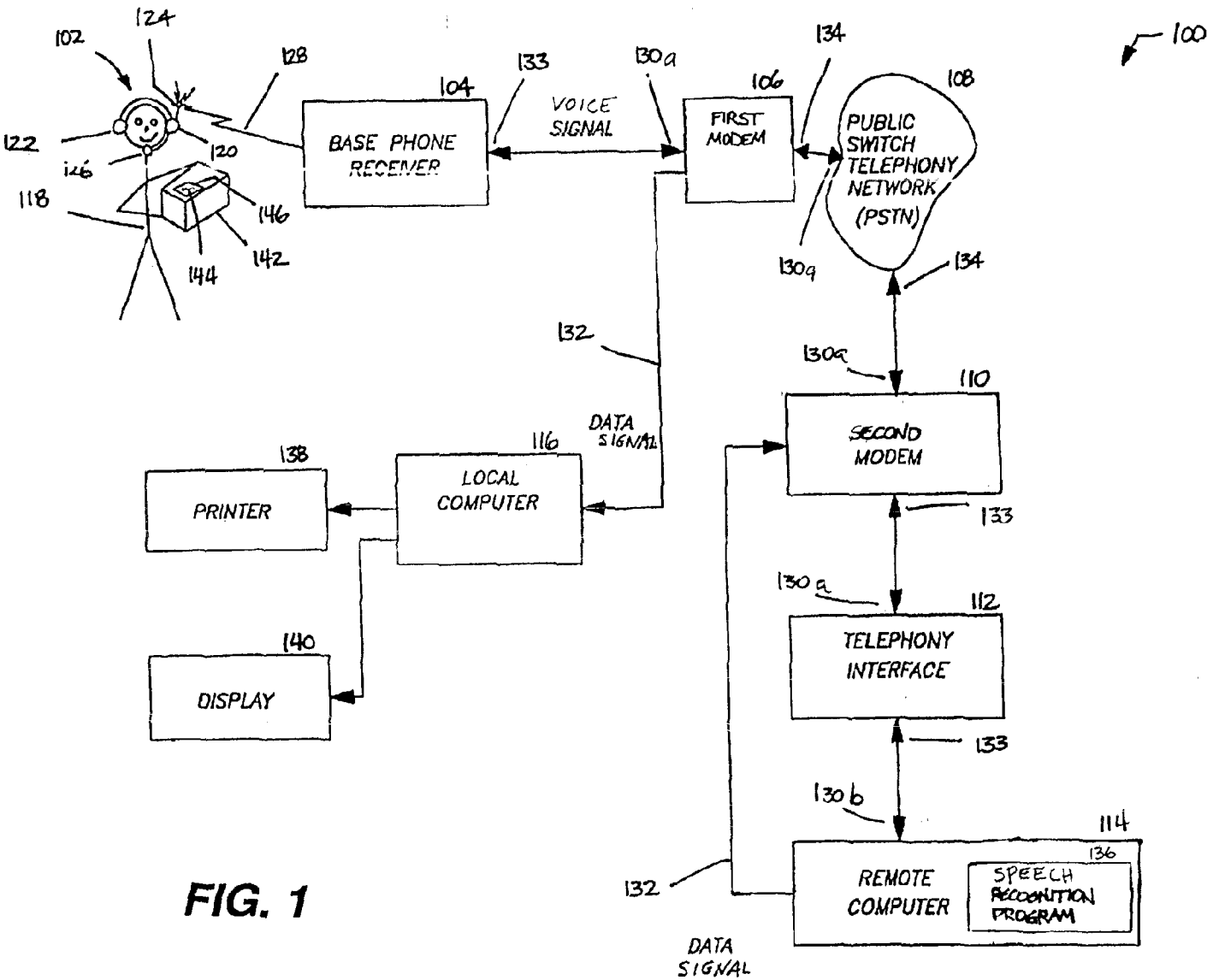
FIG. 1 is a functional block diagram of a first embodiment of the present invention.

The invention may be embodied in a system for providing information for sorting mail and packages. In response to receiving a user's voice input containing sortation instructions through a public switched telephony network, a computer such as a central or remote computer uses a speech recognition program to interpret the user's voice input. A response routine associated with the central or remote computer creates a return signal, such as a data signal and a voice signal. The central or remote computer sends the return signal to an encoder device such as a SVD modem to encode the data signal with the voice signal for simultaneous signal transmission through the public switched telephony network. A decoder device such as another SVD modem receives the return signal through the public switched telephony network and separates or decodes the return signal into the data signal and the voice signal. Each signal portion of the return signal is sent to the user or to several users for various devices and applications, such as an audio headset for an audio response, a display screen or monitor for visual information display, a printer for a label or similar tangible feedback, or similar types of peripheral devices for other mail or sortation functions.

The present invention can be embodied in a system with a computer such as a central or remote computer connected to a first SVD modem in communication with a second SVD modem through a public switched telephony network. A user communicates with the system through a wireless telephony set in communication with a base phone receiver. The wireless telephony set sends a radio communication transmission to the base phone receiver. The base phone receiver sends the user's voice input to the first SVD modem. The first SVD modem converts the user's voice input into a voice signal for transmission through the public switched telephony network to the second SVD modem. The second SVD modem receives the voice signal containing the user's voice input, and sends the voice signal to the central or remote computer. In some cases a telephony interface receives the digital signal prior to the signal reaching the central or remote computer. A speech recognition program associated with the central or remote computer interprets the user's voice input, and a response routine stored in the computer compares the user's voice input to a database of sortation information. The response routine generates a return signal containing, for example, a voice signal and a data signal in response to the user's voice input.

The response routine sends the return signal to the second SVD modem to encode the data signal with the voice signal for simultaneous transmission to the first SVD modem through the public switched telephony network. When the first SVD modem receives the return signal, the modem decodes the return signal into the voice signal and the data signal. The first SVD modem sends the voice signal to the base telephone receiver for further transmission to the user through the wireless telephony set. Furthermore, the first SVD modem sends the data signal to a local computer for processing of the signal for use with a display screen or monitor, a printer for formatting and printing a label, or another peripheral device.

The wireless telephony set can be any device that permits the user to communicate a voice input for transmission through a public switched telephony network, or similar type of network. A base telephone receiver can be any device that can exchange signals between a wireless telephony set and a modem.

The SVD modems used with the invention can be any type of modem or device that can send and receive simultaneous signals such as a data signal and a voice signal. Furthermore, the SVD modems can be any device that can encode a data signal with a voice signal, and further decode the data signal from the voice signal. The public switched telephony network can be any type of network for exchanging signals such as analog and digital signals between two SVD modems.

The telephony interface can be any type of interface for sending and receiving signals from a computer. The computer can be a central or remote computer, or any type of computer or device that can execute a stored set of instructions for recognizing a user's voice input, for generating a response to the user's voice input, and for generating a return signal such as a data signal and a voice signal to be sent back to the user. Typically, a central or remote computer is located away from the user's location, and is accessible by the user through a telephony system or a computer network connection. In some cases, the central or remote computer can be located near or at the user's location, but access is still made by the user through a telephony system or a computer network connection. The local computer can be any type of computer or device that can receive a data signal and process the signal for input to a peripheral device such as a printer, or a display screen or monitor. Typically, a local computer is located at or near the user's location, and can be readily accessible by the user if the data signal is processed for feedback such as a label, a visual display, or similar type of feedback. However, there are some cases when the local computer is positioned at a location inaccessible to the user, but the data signal is sent to another user for feedback such as printing a label, displaying a visual output, or for another similar type of feedback.

Referring now to the drawings, in which like numerals indicate like elements throughout the several views, FIG. 1 illustrates a first embodiment of the present invention. The system 100 includes a wireless telephony set 102, a base phone receiver 104, a first modem 106, a public switched telephony network (PSTN) 108, a second modem 110, a telephony interface 112, a central or remote computer 114, and a local computer 116.

The wireless telephony set 102 can be a conventional telephony headset configured to exchange signals between a user 118 and a base phone receiver 104 over a selected radio frequency. The wireless telephony set 102 includes a wireless receiver 120 connected to a speaker 122, and a wireless transmitter 124 connected to a microphone 126. The user 118 wears the wireless telephony set 102 upon the user's head or any other part of the user's body where the user 118 can speak into the microphone 126 and listen for an output signal through the speaker 122. The wireless transmitter 124 is configured to send a radio signal 128 over a radio frequency from the wireless headset 102 to the base phone receiver 104. The wireless receiver 120 is configured to receive a radio signal 128 over a radio frequency from a base phone receiver 104, and further configured to transmit the signal 128 to the speaker 122. A suitable wireless telephony set is a VL2h Voice Link system manufactured by Voice Communication Interface, Inc. of Wilton, Conn.

The base phone receiver 104 is configured for communicating a telephony signal 130*a* between the wireless telephony set 102 and the first modem 106. Typically, the base phone receiver 104 connects to the first modem 106 by a conventional telephony line. However, telephony connections may include the Internet, wireless communications, and other suitable links. A base phone receiver 104 can for example, be configured to communicate a telephony signal 130*a* with the first modem 106 over a radio frequency.

The first modem 106 connects between the base phone receiver 104 and the PSTN 108, and between the PSTN 108 and a local computer 116. The first modem 106 is configured for sending and receiving a telephony signal 130*a* from the base phone receiver 104, as well as for transmitting the telephony signal 130*a* to the PSTN 108. The first modem 106 is further configured for receiving a data signal 132, a voice signal 133, or a combination of the two such as a composite return signal 134 from the PSTN 108. Using conventional decoding methods and equipment, the first modem 106 is configured to decode or separate a composite return signal 134 with a data signal 132 and a voice signal 133 into a separate data signal component 132 and a voice signal component 133. The first modem 106 is further configured to send the data signal 132 to a local computer 116, and send the voice signal 133 to the base phone receiver 104.

For example, in response to a user's voice input containing sortation information such as a delivery address, a return signal can be created with a voice signal containing a sortation instruction such as a particular sorting bin number to sort a piece of mail or package into, and a data signal containing a sortation instruction such as the particular bin number to sort a piece of mail or package. The voice signal is sent to the base telephone receiver, and transmitted to the user's wireless telephony set for audio receipt of the particular sorting bin number by the user, while the data signal is sent to the local computer for transmission to an associated printer to format and to print a label containing the particular sorting bin number. Other types of signals can be created such as a confirmation tone, or a pre-recorded or computer generated voice response. Other data signals can be created such as text or numeric strings. Using a voice signal combined with a data signal, a return signal can provide sortation information to the user to verify, correct, prompt, or otherwise provide feedback to the user's spoken sortation information.

A suitable first modem is a simultaneous voice and data (SVD) modem capable of communicating a voice signal to and from the base phone receiver 104, and for decoding an encoded data signal received from the PSTN 108. For example, a suitable first modem uses an RC288Aci/SVD chipset manufactured by Rockwell Telecommunications of Newport Beach, Calif.

The PSTN 108 connects between the first modem 106 and the second modem 110. The PSTN 108 is a conventional public switched telephony system or other type of communication network configured for communicating a telephony signal, a data signal, or a combination of the two signals between the first modem 106 and the second modem 110. The PSTN 108 communicates these types of signals between the first modem 106 and the second modem 110 by a conventional telephony line or through a radio frequency.

The second modem 110 connects between the PSTN 108 and a telephony interface 112 for a computer. The second modem 110 is configured for communicating a voice signal 130*a* containing spoken sortation information from the PSTN 108 to a telephony interface 112. Furthermore, the second modem 110 is configured for encoding and sending a return signal such as a data signal 132, or a voice signal 133, or a combination of the two signals such as a composite return signal 134. The second modem 110 uses conventional methods and techniques to encode the data signal 132 with the voice signal 133 to form a composite return signal 134. A suitable second modem can be a simultaneous voice and data (SVD) modem capable of multiplexing voice signal with other signals such as a data signal. For example, a suitable second modem uses a RC288Aci/SVD chipset manufactured by Rockwell Telecommunications of Newport Beach, Calif.

The telephony interface 112 connects between the second modem 110 and a computer such as a central or remote computer 114. The telephony interface 112 is configured for receiving a voice signal 130*a* from the second modem 110, and further configured for converting the received signal 130*a* to a useful format for the central or remote computer 114. A suitable telephony interface can be a conventional analog-to-digital converter for converting a voice signal 130*a* to a digital signal 130*b* for a computer.

As noted, the central or remote computer 114 connects to the telephony interface 112. The central or remote computer 114 is configured to process a received digitized signal or telephony signal 130*b* containing the spoken sortation information from the telephony interface 112, and is further configured to generate a return signal such as a data signal 132, a voice signal 133, or a combination of the two, such as a data signal 132 encoded with a voice signal 133 in response to the spoken sortation information. Typically, the central or remote computer 114 stores a set of instructions containing a speech recognition program 136, or the set of instructions with a speech recognition program 136 can be stored in an external device (not shown) or format accessible by the central or remote computer 114. The computer 114 executes the speech recognition program 136 to process the received signal containing the spoken sortation information into a computer-readable format, such as a data string that can be processed by the computer 114.

The computer 114 is configured to execute a stored set of instructions containing a response routine (not shown) to use the spoken sortation information processed from the speech recognition program 136 to generate a return signal. Typically, the computer 114 can access a database (not shown) or a storage device containing sortation information. For example, the computer 114 is configured to process the received spoken sortation information such as a delivery address by checking a database such as a database containing previously stored delivery addresses to verify the accuracy of the received sortation information. The response routine is configured to use the database sortation information to create a return signal such as a digitized signal containing a voice response with the particular sorting bin number and a data signal with the particular sorting bin number corresponding to the user's spoken delivery address. Other response routines can be configured to use spoken sortation information processed from the speech recognition program 136 to generate a return signal based upon comparison to a database, information in a storage device, or data stored in other similar structures or devices.

Thus, in response to the received spoken sortation information, the central or remote computer 114 is configured to generate a return signal such as a data signal 132 or a voice signal 133, or a combination of the two, as a composite return signal 134. The computer 114 can send the return signal back to the user 118 or to a local computer 116 for associated uses in the following manner.

The central or remote computer 114 connects to the second modem 110. As previously described, the second modem 110 is configured for multiplexing a voice signal with other signals such as a digital signal. That is, the second modem 110 is configured to transmit a return signal containing a combination of voice and data signals from the computer 114 to the PSTN 108. Furthermore, the PSTN 108 connects to the first modem 106, and is configured to transmit simultaneous voice and data signals from the second modem 110 to the first modem 106.

The local computer 116 connects between the first modem 106 and computer peripheral devices such as a printer 138 and display screen 140. The local computer 116 is configured for processing the decoded data signal component from the central or remote computer 114. The processed data signal component can be formatted with an associated printer 138 connected to the local computer 116. In addition, the processed data signal component can be formatted and printed for visual display on an associated display screen 140 connected to the local computer 116. Other associated computer peripheral devices such as a storage device or other output devices can be configured to receive the processed data signal component from the local computer 116. Alternatively, the first modem 106 can connect directly to a computer peripheral device, such as the printer 138 or the display screen 140, where the first modem 106 is configured to bypass the local computer 116 to send the decoded data return signal directly to the computer peripheral device 138, 140.

To operate a telephony-based speech recognition system 100, a user 118 wears a wireless telephony set 102. The user 118 initiates a sortation operation such as sorting a package 142, or a letter, a parcel, and the like. The user 118 reads sortation information, such as a package delivery address 144 on a label 146 associated with the package 142, into a microphone 126 of the wireless telephony set 102. The microphone 126 transfers the spoken sortation information to a wireless transmitter 124 of the wireless telephony set 102. The wireless transmitter 124 sends a radio signal 128 containing the spoken sortation information over a radio frequency to a base phone receiver 104.

The base phone receiver 104 receives the radio signal 128 from the transmitter 124, and generates a voice telephony signal 130*a* containing the spoken sortation information. The base phone receiver 104 sends the voice telephony signal 130*a* to a first modem 106 by way of a radio frequency or conventional telephony line.

The first modem 106 receives the voice telephony signal 130*a* containing the sortation information from the base phone receiver 104. The first modem 106 sends the voice telephony signal 130*a* containing the spoken sortation information through the public switched telephony network (PSTN) 108. The PSTN 108 receives the voice signal 130*a* containing the spoken sortation information from the first modem 106, and transmits the signal 130*a* to a second modem 110 by way of a radio frequency or conventional telephony line.

When the second modem 110 receives the voice signal 130*a* from the PSTN 108, the second modem 110 sends the voice signal 130*a* to a telephony interface 112. The telephony interface 112 receives the signal 130*a* from the telephony interface 112, and converts the signal 130*a* to a format 130*b* to allow the central or remote computer 114 to execute a speech recognition program 136.

When the central or remote computer 114 receives the converted signal 130*b* from the telephony interface 112, the computer 114 executes a set of instructions containing a speech recognition program 136 to interpret the spoken sortation information in the converted signal 130*b*. The speech recognition program 136 processes the spoken sortation information to determine the content of the spoken sortation information. For example, the spoken sortation information can contain a delivery address 144 on a label 146 affixed to a package 142. The speech recognition program 136 interprets the converted signal 130*b* as the user-spoken delivery address for use by an associated response routine (not shown).

The response routine uses the results from the speech recognition program 136 to generate a return signal such as a digitized voice signal 133 or a data signal 132, or both as a composite return signal 134, in response to the spoken sortation information. A return signal is a response sent back to the user 118, to the local computer 116, or to a computer peripheral device 138, 140 based upon the spoken sortation information, such as a delivery address 144. For example, the computer 114 can access an internal or external database to verify or compare the spoken sortation information containing a delivery address 144 with previously stored addresses. In response to finding a matching address to the delivery address, the computer 114 generates a corresponding return signal such as a validated text string. The validated text string can contain a verification code authorizing the delivery of the package to the delivery address 144, or to a particular sorting bin corresponding to the delivery address 144. Alternatively, in response to finding no matching delivery address, the computer 114 generates a corresponding return signal such as a validated text string containing a code rejecting the delivery of the package to the delivery address 144. In either case, the validated text string in the return signal is sent to the user 118 to verify, correct, prompt, or otherwise provide feedback for the user's spoken sortation information.

Other examples of a return signal that can be generated by the computer such as a central or remote computer 114 are a voice signal that contains a prompt for a user, a query for additional sortation information, or other similar types of feedback for the user 118. Yet another example of a return signal that can be generated by the central or remote computer 114 is a composite return signal 134 such as a data signal 132 encoded with a voice 133. The data signal 132 can contain return sortation information, such as a sorting bin identification code, a confirmation code, and the voice signal 133 can contain an audio confirmation response.

The central or remote computer 114 sends the voice signal 133 back to the user 118 through the system 100. The voice signal portion 133 is sent from the central or remote computer 114 through the telephony interface 112 to the second modem 110. The second modem 110 receives the voice signal 133 from the telephony interface 112.

The digital signal 132 is sent from the central or remote computer 114 directly to the second modem 110. The second modem 110 receives both the data signal 132 and the voice signal 133, and encodes the data signal 132 with the voice signal 133 to form a composite return signal 134. The second modem 110 sends the composite return signal 134 containing the data signal 132 and the voice signal 133 through the PSTN 108 to the first modem 106.

The first modem 106, previously described as configured to handle simultaneous voice and data transmission, receives the composite return signal 134 containing voice signal 133 and the data signal 132. The first modem 106 decodes the composite return signal 134 into the separate voice signal 133 and the data signal 132. The decoded voice signal 133 is sent to the user 118 through the base wireless phone receiver 104. The base wireless phone receiver 104 receives the voice signal 133 from the first modem 106, and then sends the voice signal 133 to the wireless receiver 120 in the user's wireless telephony headset 102. The user 118 receives the voice signal 133 in the form of an audio signal containing return sortation information, such as a sorting bin number or a confirmation tone, transmitted from the wireless receiver 120 to the speaker 122 in the user's wireless telephony headset 102.

The decoded data signal portion 132 is sent by the first modem 106 to a local computer 116 connected to the first modem 106. The local computer 116 receives the data signal 132, and uses the data signal 132 as input into a stored set of instructions. The local computer 116 can execute the stored set of instructions to instruct an associated printer 138 to print a label with a MaxiCode symbol, a bar code, a zip code, or other type of machine-readable code or text information, or to display information on an associated display monitor 140 or screen.

Alternatively, the first modem 106 can send the data signal 132 to a printer 138 associated with the first modem 106. Using the data signal 132, the printer 138 can format and print return sortation information contained within the data signal portion 132. Furthermore, the data signal 132 can also be sent directly from the first modem 106 to a display monitor 140 or screen associated with the first modem 106. Using the data signal 132, the display monitor 140 or screen can visually display return sortation information contained within the data signal portion 132.

Figure 2:
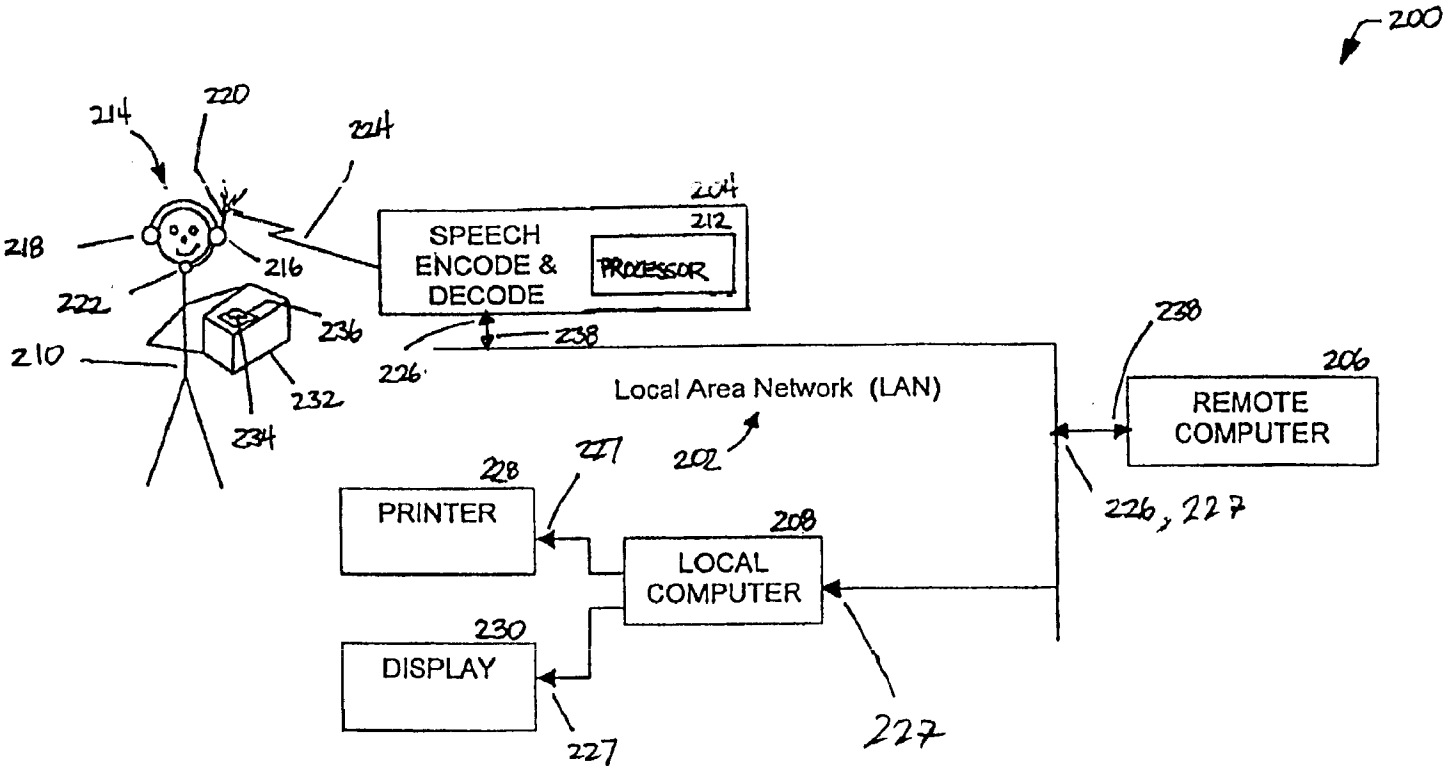
FIG. 2 is a functional block diagram of a second embodiment of the present invention.

FIG. 2 is a functional block diagram of a second embodiment of the present invention. The present invention is shown embodied in system 200 including a local area network (LAN) of computers 202. The system 200 includes a speech device such as a speech encoder/decoder 204 in communication with the LAN 202 to exchange speech input signals and speech output signals with one or more associated computers 206, 208. The speech encoder/decoder 204 is configured for digitally encoding a voice input signal from a user 210 for use by a computer. Furthermore, the speech encoder/decoder 204 is configured for decoding or converting a return signal from the LAN 202 to an audio format for the user 210. The speech encoder/decoder 204 includes a processor 212 to convert a user's voice input into a digital signal format that can be communicated through the LAN 202 to one or more associated computers 206, 208. For example, a speech encoder/decoder 204 can include a processor configured with Voice over the Internet Protocol (VoIP), or with a similar type protocol providing voice transmission over the Internet. Alternatively, the processor may be equipped with a speech recognition hardware or software module to convert a user's voice input to a format for transmission over the LAN 202 or Internet.

A wireless set 214 worn by the user 210 communicates with the speech encoder/decoder device 204 to exchange signals. The wireless set 214 can be similar to the wireless telephony set 102 described in FIG. 1, and can include similar type components such as a wireless receiver 216 connected to a speaker 218, and a wireless transmitter 220 connected to a microphone 222. A user 210 wears the wireless set 214 upon the user's head or any other part of the user's body where the user 210 can speak into the microphone 222 and listen for an output signal through the speaker 218.

The wireless transmitter 220 is configured to receive a user's voice input containing user spoken sortation information from the microphone 222, and converts the user's voice input into a signal 224. The wireless transmitter 220 is further configured to send the signal 224 over a radio frequency to the speech encoder/decoder 204. The wireless receiver 216 is also configured to receive a signal 224 over a radio frequency from the speech encoder/decoder 204, and further configured to transmit the signal 224 to the speaker 218. A suitable wireless headset is a VL2h Voice Link system manufactured by Voice Communication Interface, Inc. of Wilton, Conn.

The LAN 202 is a distributed network of computers. The present invention can also be implemented with the Internet, an intranet, or other type of computer network. The LAN 202 connects between the speech encoder/decoder 204 and a computer such as a remote computer 206. The LAN 202 is configured for transmitting a user's voice input that has been converted into a signal format using Voice over the Internet Protocol (VoIP) or a similar type protocol, or transmit a signal from speech recognition hardware or software as described above. Furthermore, the LAN 202 is configured for transmitting a data and encoded voice output return signal generated by the remote computer 206.

The remote computer 206 is connected to the LAN 202 by a conventional data link so that the remote computer 206 is configured to communicate with the LAN 202. The remote computer 206 is further configured for receiving a user's voice input that has been converted into a digital signal format using Voice over the Internet Protocol (VoIP) or a similar type protocol, or a signal from a speech recognition hardware or software module. Typically, a computer such as a remote computer 206 is at a location away from the location of the user 210 and further inaccessible to user, except by communication through the LAN 202. In some cases, the local computer 208 is positioned at the location of or near the location of the user 210, however, the local computer 208 remains connected to the LAN 202 in communication with the local computer 208. Using conventional speech recognition hardware or software (not shown), the remote computer 206 can process a signal format containing the user's voice input to determine a text string containing the user's spoken sortation information. In response to the user's spoken sortation information, the remote computer 206 uses a response routine (not shown) to generate a digital data return signal 227, or an encoded audio output return signal 226, or both 226, 227. Typically, the remote computer 206 compares the spoken sortation information of the signal received from the LAN 202 to sortation information in an associated database. The remote computer 206 generates a digital data return signal 227, or an encoded audio output return signal 226, or both 226, 227, based upon the comparison of the text string containing the spoken sortation information with the sortation information in the associated database. A suitable remote computer 206 is a Deskpro Pentium III desktop computer manufactured by Compaq Computer Corporation of Houston, Tex.

A local computer 208 connects to the LAN 202 with a conventional link so the local computer 208 can communicate with the LAN 202. The local computer 208 is a computer connected to the LAN 202 in communication with the remote computer 206. Typically, the local computer 208 is located at the location of or near the location of the user 210. In some cases, the local computer 208 is positioned at a location inaccessible to the user 210, however, the local computer 208 remains connected to the LAN 202 in communication with the remote computer 206. The local computer 208 is configured to receive an output return signal that is a digital data return signal 227 from the remote computer 206 through the LAN 202. The local computer 208 can process the digital data return signal 227, and send a digital data return signal 227 to an associated printer 228 or a screen display 230 or monitor, or both. Other associated computer peripheral devices such as a storage device or other output devices can be configured to receive the digital data return signal from the local computer 208.

The printer 228 receives the digital data return signal 227 from the local computer 208. The printer 228 is configured for formatting and a printing information contained within the digital data return signal 227.

The screen display 230 or monitor receives the digital data return signal 227 from the local computer 208. The screen display 230 or monitor is configured for formatting and displaying information contained within the digital data return signal 227.

Alternatively, the remote computer 206 can send the digital data return signal 227 directly to a printer 228 associated with the LAN 202. Using the digital data return signal 227 the printer 228 can format and print return sortation information contained within the digital data return signal 227. Furthermore, the digital data return signal 227 can also be sent directly from the remote computer 206 to a display monitor 230 or screen associated with the local computer 208. Using the digital data return signal 227, the display monitor 230 or screen can is visually display sortation information contained within the digital data return signal 227.

To operate the system 200, a user 210 wears the wireless headset 214. The user 210 initiates a sortation operation such as sorting a package 232, or a letter, a parcel, and the like. The user 210 reads sortation information, such as a package delivery address 234 on a label 236 associated with the package 232, into the microphone 222 of the wireless headset 214. The microphone 222 transfers the spoken sortation information to the transmitter 220, and the transmitter 220 sends a radio signal 224 to the speech encoder/decoder 204. The speech encoder/decoder 204 receives the radio signal 224, and the processor 212 converts the radio signal 224 into a digital signal for transmission over the LAN 202 using Voice over the Internet Protocol (VoIP) or a similar type protocol. Alternatively, the processor 212 may be equipped with conventional speech recognition hardware or software (not shown) that can convert the radio signal 224 containing spoken sortation information into a digital signal for transmission over the LAN 202 or Internet. The speech encoder/decoder 204 sends a signal 238 containing the spoken sortation information to the LAN 202.

The LAN 202 receives the signal 238 from the speech encoder/decoder 204, and transmits the signal 238 to the remote computer 206. The remote computer 206 receives the signal 238 from the LAN 202, and uses conventional speech recognition hardware or software (not shown) to process the signal 238 containing the spoken sortation information. In response to the spoken sortation information, the remote computer 206 generates an output return signal containing a digital data return signal 227, an encoded audio output return signal 226, or both 226, 227. The remote computer 206 sends the output return signal containing an encoded audio return signal 226 back to the speech encoder/decoder 204 through the LAN 202.

For example, the remote computer 206 can receive a signal 238 from the LAN 202 comprising spoken sortation information, such as a delivery address 234. Using a speech recognition hardware or software module, the remote computer 206 processes the signal 238 into a text string format. The remote computer 206 compares the text string containing the spoken sortation information with an associated database (not shown) containing sortation information such as previously stored addresses. The remote computer 206 accesses the associated database to verify or compare the text string containing the spoken sortation information with previously stored addresses in the associated database. In response to finding a matching address to the spoken sortation information, the computer 206 generates a corresponding output return signal containing a digital data return signal 227 or an encoded audio output return signal 226, or both 226, 227, such as a validated text string. The validated text string can contain a verification code authorizing the delivery of the package to the delivery address. The remote computer 206 sends the output return signal containing the digital data return signal 227, an encoded audio output return signal 226, or both 226, 227, back to the speech encoder/decoder device through the LAN 202.

Alternatively, in response to finding no matching delivery address, the remote computer 206 generates a corresponding output return signal 226 such as a validated text string containing a code rejecting the delivery of the package to the delivery address 234. In either case, an output return signal 226 containing an encoded audio output return signal 226 is sent to the user 210 to verify, correct, prompt, or otherwise provide feedback for the user's spoken sortation information.

Other examples of an output return signal that can be generated by a computer such as a remote computer 206 are an audio signal that contains a prompt for a user, a query for additional sortation information, or other similar types of feedback for the user 210. Another example of an output return signal that can be generated by the remote computer 206 is a digital data signal portion 227. The digital data signal portion 227 can contain return sortation information, such as a confirmation code for a printer or a display.

The LAN 202 receives the output return signal 226 from the remote computer. The LAN 202 sends the output return signal 226 to the speech encoder/decoder 204. The wireless receiver 216 of the speech encoder/decoder 204 receives the output return signal 226 from the LAN 202. The encoder/decoder 204 sends the output return signal 226 to the processor 212. The processor 212 decodes the output return signal 226 into an analog audio signal. The decoded audio signal is sent as a signal 224 through a radio frequency to the receiver 220 of the wireless set 218. The receiver transfers the signal 224 to the speaker 218 of the wireless set 218. The user 210 listens to the signal 224 in the form of an audio signal containing return sortation information transmitted from the speaker 218.

The processor 212 can also send a decoded digital data signal 227 to the user 210. The processor 212 can operate in conjunction with conventional speech synthesis software or hardware (not shown) to create synthesized speech. The synthesized speech can be sent to the user 210 through the speaker 218 in the user's wireless set 218. For example, a digital data signal 227 containing return sortation information can be processed by the speech synthesis software or hardware module to create a synthesized speech command. The processor 212 sends the synthesized speech command through a signal 224 by radio frequency to the receiver 220. The receiver 220 transfers the signal to the speaker 218, so that the speaker 218 can broadcast the synthesized speech command to the user 210.

Figure 3:
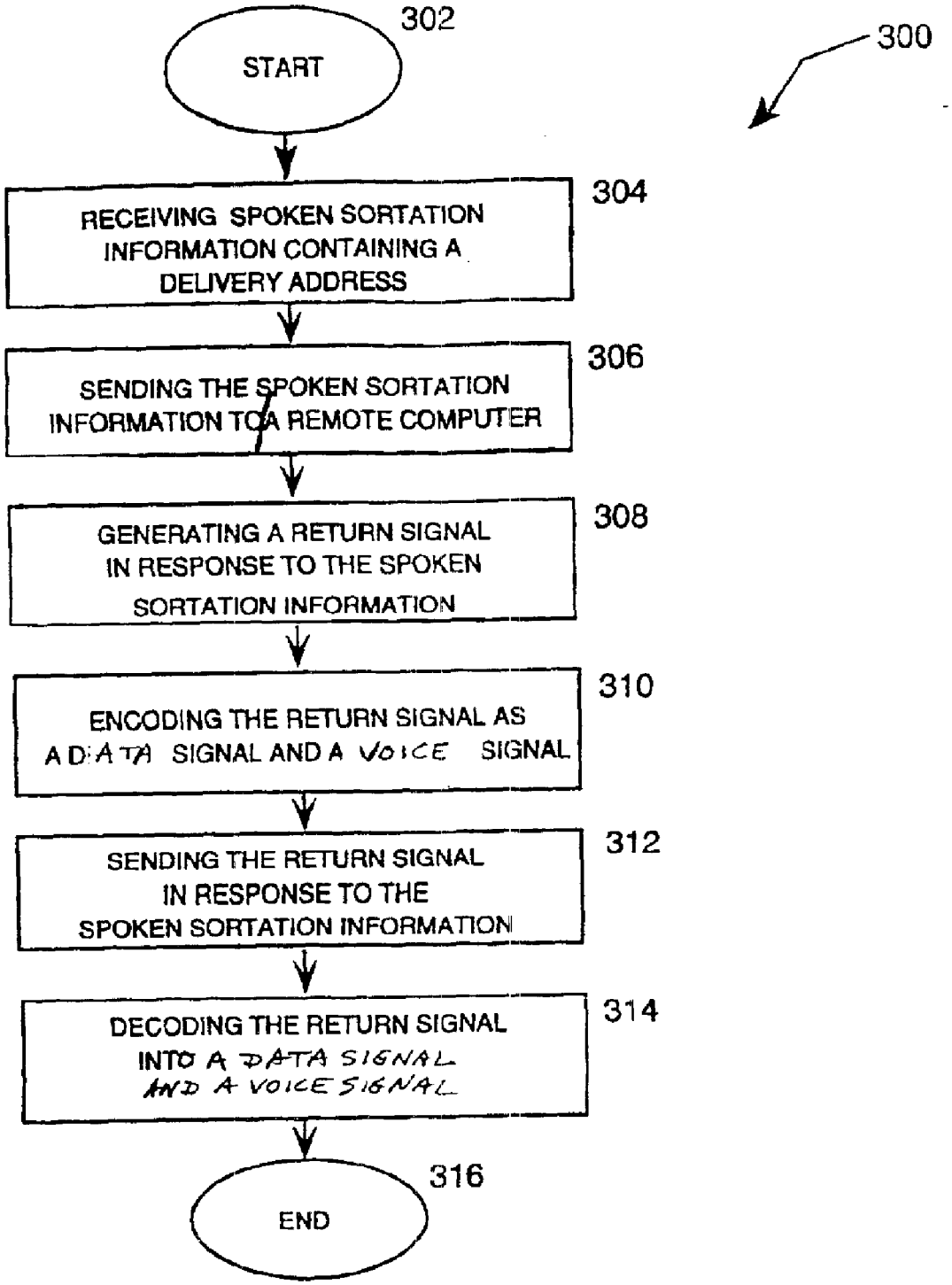
FIG. 3 is a flowchart illustrating a first method of the present invention.

FIG. 3 is a logic flow diagram illustrating a first method of the present invention. The first method 300 can be used with different embodiments of the invention. For example, the first method 300 is described as follows in conjunction with the system 100 described in FIG. 1. The first method 300 begins at step 302.

Step 302 is followed by step 304, in which the system 100 receives spoken sortation information containing a package address from a user. As shown in FIG. 1, a user 118 wears a wireless telephony set 102. The user 118 initiates a sortation operation such as sorting a package 142, or a letter, a parcel, and the like. The user reads sortation information, such as a delivery address 144 on an associated label 146 on the package 142, into a microphone 126 of a wireless telephony set 102.

Step 304 is followed by step 306, in which the system 100 sends the spoken sortation information to a remote computer 114. The microphone 126 transfers the spoken sortation information to a transmitter 124 that sends a radio signal 128 containing the spoken sortation information to a base phone receiver 104. The base phone receiver 104 sends a voice signal **130*a* containing the spoken sortation information to a first modem 106 by way of a radio frequency or conventional telephony line. The first modem 106 sends the voice signal 130*a* containing the spoken sortation information through a public switched telephony network (PSTN) 108. The PSTN 108 transmits the signal 130*a* to a second modem 110 by way of a radio frequency or conventional telephony line. The second modem 110 sends the voice signal 130*a* to a telephony interface 112. The telephony interface converts the signal 130*a* to a format for a computer such as a remote computer 114 executing a speech recognition program 136. The remote computer 114 receives the converted signal 130*b* from the telephony interface 112, and processes the converted signal 130*b*** into sortation information.

Step 306 is followed by step 308, in which the system 100 generates a return signal, such as a data signal 132, a voice signal 133, or a combination of the two in a composite return signal 134, in response to receiving the spoken sortation information such as a delivery address 144. The remote computer 114 executes a set of instructions containing a speech recognition program 136 to interpret the spoken sortation information containing the delivery address in the converted signal 130*b*. The speech recognition program 136 processes the spoken sortation information to determine sorting and/or delivery information. For example, the spoken sortation information can contain a delivery address 144 from a package 142 or a label 146. A response routine, (not shown) uses the delivery address 144 from the speech recognition program 136 to generate a return signal in response to the spoken sortation information. A return signal is a response sent back to the user 118, to the local computer 116, or to a computer peripheral device 138, 140 based upon the spoken sortation information. For example, the computer 114 can access an internal or external database to verify or compare the spoken sortation information containing a delivery address 144 with previously stored addresses. In response to finding a matching address to the delivery address 144, the computer 114 generates a corresponding return signal such as a validated text string. The validated text string can contain a verification code authorizing delivery to the delivery address 144. Alternatively, in response to finding no matching delivery address, the computer 114 generates a corresponding return signal such as a validated text string containing a code rejecting the delivery to the delivery address 144. In either case, the validated text string in the return signal is sent to the user 118 to verify, correct, prompt, or otherwise provide feedback for the user's spoken sortation information.

Step 308 is followed by step 310, in which the system 100 encodes the return signal as a data signal 132, a voice signal 133, or a combination of the two as a composite return signal 134. The remote computer 114 sends the voice signal 133 through the telephony interface 112 to the second modem 110. The second modem 110 receives the voice signal 133 from the telephony interface 112. The data signal 132 is sent from the central or remote computer 114 directly to the second modem 110. The second modem 110 receives both the data signal 132 and the voice signal 133, and encodes the data signal 132 with the voice signal 133 to form a composite return signal 134.

Step 310 is followed by step 312, in which the system 100 sends the composite return signal 134 to the first modem 106. The second modem 110 sends the composite return signal 134 containing the data signal 132 and the voice signal 133 through the PSTN 108 to the first modem 106.

Step 312 is followed by step 314, in which the system 100 decodes the composite return signal 134. The first modem 106 decodes the return signal 134 into the separate voice signal 133 and the data signal 132. The decoded voice signal 133 can be sent to the user 118 through the base wireless phone receiver 104. The base wireless phone receiver 104 receives the voice signal 133 from the first modem 106, and then sends the voice signal 133 to the wireless receiver 120 in the user's wireless telephony headset 102. The user receives the voice signal 133 in the form of an audio signal containing return sortation information transmitted from the wireless receiver 120 to the speaker 122 in the user's wireless telephony headset 102.

The decoded data signal 132 can be sent by the first modem 106 to a local computer 116 connected to the first modem 106. The local computer 116 receives the data signal 132, and uses the data signal 132 as input into a stored set of instructions. The local computer 116 can execute the stored set of instructions to instruct an associated printer 138 to print a label, or to display information on an associated display monitor 140 or screen.

Step 314 is followed by step 316, in which the method 300 ends.

In view of the foregoing, it will be appreciated that the invention provides a telephone-based speech recognition system for providing information for use in sorting packages and letters. The present invention provides a telephone-based speech recognition system for providing information for use in sorting packages and letters that is comfortable to wear, and easier to operate and to maintain than conventional systems and apparatuses. Furthermore, the present invention provides a telephony-based speech recognition system for providing information for sorting mail and packages that can return simultaneous signals to the user for feedback. It will be understood that the preferred embodiment has been disclosed by way of example, and that other modifications may occur to those skilled in the art without departing from the scope and spirit of the appended claims.

What is claimed is:

1. A system for processing sortation information spoken by a user, and for generating a return signal with a computer for transmission back to the user on a telephony system in response to sortation information spoken by the user, comprising:

a wireless telephony set being operative to:
- receive sortation information spoken by a user;
- send the sortation information to a first modem, the first modem being operative to:
- send spoken sortation information from the wireless telephony set to a second modem through the telephony system;

the second modem being operative to:
- receive spoken sortation information from the first modem;
- send spoken sortation information to a computer; and the computer being operative to:
- receive the spoken sortation information from the second modem;
- generate a return signal comprising an voice signal and a data signal in response to the spoken sortation information;
- send the voice signal and the data signal to the second modem;

the second modem further operative to:
- encode the data signal with the voice signal for transmission to the first modem through the telephony system;

the first modem further operative to:
- decode the data signal and the voice signal from the second modem into the separate voice signal and data signal;
- send the voice signal to the wireless telephony set; and the wireless telephony set further operative to:
- receive the voice signal from the computer.

2. The system of claim 1, wherein the spoken sortation information comprises a delivery address.

3. The system of claim 1, wherein the wireless telephony set comprises a transmitter being operative to send spoken sortation information to the first modem, and a receiver being operative to receive a return signal from a first modem.

4. The system of claim 3, wherein the wireless telephony set further comprises a microphone being operative to receive spoken input from a user and a speaker being operative to broadcast the return signal received by the receiver.

5. The system of claim 1, wherein the wireless telephony set further comprises:

a base phone receiver being operative to:

receive spoken sortation information from the transmitter, and send the spoken sortation information to the first modem.

6. The system of claim 1, wherein the telephony system comprises a wireless telephone network.

7. The system of claim 6, wherein the telephony system comprises a public switched telephone network.

8. The system of claim 1, wherein the computer further comprises a telephony interface being operative to transfer spoken sortation information from the second modem to the remote computer.

9. The system of claim 1, wherein the computer is further operative to execute a set of instructions containing a speech recognition routine to interpret the spoken sortation information.

10. The system of claim 1, wherein the computer comprises a remote computer.

11. The system of claim 1, wherein the first modem comprises a simultaneous voice and data (SVD) modem.

12. The system of claim 11, wherein the second modem comprises a simultaneous voice and data (SVD) modem.

13. The system of claim 1 wherein the return signal comprises a prompt for the user to respond to the accuracy of the spoken sortation information.

14. The system of claim 1 wherein the return signal comprises a sortation instruction.

15. The system of claim 1, wherein the first modem is further operative to decode the return signal into an voice signal and a data signal.

16. The system of claim 15, wherein the first modem is further operative to send the data signal to a local computer.

17. The system of claim 16, wherein the data signal is processed by the local computer, and the local computer instructs an associated printer to format or to print a label.

18. The system of claim 16, wherein the data signal is processed by the local computer, and the local computer displays the information on an associated visual display device.

19. The system of claim 15, wherein the first modem sends the data signal to an associated printer to format or to print a label.

20. The system of claim 15, wherein the first modem sends the data signal to an associated visual display device to display information.

21. The system of claim 15, wherein the voice signal comprises audio instructions in response to the user's spoken sortation information.

* * * * *